US006521057B1

(12) United States Patent
Itakura et al.

(10) Patent No.: US 6,521,057 B1
(45) Date of Patent: Feb. 18, 2003

(54) HIGH-STRENGTH HIGH-TOUGHNESS STEEL PRODUCTS

(75) Inventors: Noritsugu Itakura, Okayama (JP); Mitsuhiro Okatsu, Okayama (JP); Fumimaru Kawabata, Okayama (JP); Keniti Amano, Okayama (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/929,057

(22) Filed: Aug. 15, 2001

Related U.S. Application Data

(62) Division of application No. 09/272,572, filed on Mar. 19, 1999, now Pat. No. 6,299,710.

(30) Foreign Application Priority Data

Mar. 23, 1998 (JP) ..... 10-073944

(51) Int. Cl.[7] ..... C22C 38/12; C22C 38/04
(52) U.S. Cl. ..... 148/330; 420/121; 420/127
(58) Field of Search ..... 148/330, 320; 420/121, 127

(56) References Cited

U.S. PATENT DOCUMENTS 4,219,371 A * 8/1980 Nakasugi et al. ..... 148/330
5,948,183 A * 9/1999 Okada et al. ..... 148/330

FOREIGN PATENT DOCUMENTS

EP 0730042 9/1996
JP 20125812 5/1990

* cited by examiner

*Primary Examiner*—Deborah Yee
(74) *Attorney, Agent, or Firm*—Young & Thompson

(57) ABSTRACT

A high-strength and high-toughness steel product having at least about 0.001% and less than about 0.030% by weight C, not more than about 0.60% by weight Si, from about 0.8 to 3.0% by weight Mn, from about 0.005 to 0.20% by weight Nb, from about 0.0003 to 0.0050% by weight B, and not more than about 0.005% by weight Al, wherein at least 90% of the product has a bainite structure. A method of making this steel product is subject to less stringent production controls because of the nature of the composition.

7 Claims, 1 Drawing Sheet

HIGH-STRENGTH HIGH-TOUGHNESS STEEL PRODUCTS

This application is a division of application Ser. No. 09/272,572, filed on Mar. 19, 1999, now U.S. Pat. No. 6,299,710 issued Oct. 9, 2001, the entire contents of which are hereby incorporated by reference.

FIELD OF THE INVENTION

The present invention relates to a high-strength high-toughness steel product having less variation in quality and excellent low-temperature toughness at welded portions and to a method of producing the steel product. More particularly, the invention relates to steel products such as steel plates, steel bands, steel sections, steel bars, and the like, which are used in various fields such as buildings, marine structures, pipes, shipbuilding, preservation, public works projects, construction machines, etc., and to a method of producing these products.

BACKGROUND OF THE INVENTION

Improvements to these steel products which increase their strength, toughness, etc. have been attempted, but the improvements are not uniform in the thickness direction of a steel product and are not uniform among the steel products.

The ability of such products to withstand an earthquake is of particular importance. "Tetsu to Hagane (Iron and Steel)," Vol. 74, No. 6, 1988, pages 11 to 21, reports that as buildings get taller, they are being designed to prevent collapse during an earthquake by absorbing the vibrational energy. That is, building collapse is prevented by the plastic deformation of the structural materials. For a building to be designed to show this behavior, the designer must understand the yield point ratios of the steel products of the building.

Accordingly, it is very important that the steel products used in the building, such as steel plates, beams, etc., are homogeneous, showing little variation in the strength.

Steel products used for buildings, shipbuilding, etc., are also required to have high tension and high toughness, and thus the steel products of this kind are usually produced by the TMCP (Thermo-Mechanical-Controlled-Rolling-Process) method in which rolling and cooling are controlled.

However, when a thick steel product is made by the TMCP method, the cooling rate may not be constant during cooling treatment following rolling. This may cause the steel product to vary in quality in the thickness direction or may cause differences in the quality among steel products. By way of example, quality varies in the thickness direction of a thick steel product, there may be significant differences between the characteristics of a web and a flange in a H shaped steel.

The following references are examples of attempts to improve the uniformity of the quality of steel products.

JP-A-63-179020 ("JP-A" means an unexamined published Japanese patent application) discloses a method of reducing the hardness difference in the thickness direction of a steel plate by controlling the components of the steel, the rolling reduction, the cooling rate and the cooling-finishing temperature.

However, in the production of thick steel plates, particularly steel plates more than 50 mm thick, cooling rate changes in the thickness direction of the steel plate are inevitable, so that it is difficult to sufficiently control the difference in hardness in the thickness direction of the steel plate by the method described above.

JP-A-61-67717 discloses the use of very low-C steel to attempt to control the difference in strength in the thickness direction of a steel plate, but as shown in FIG. 3 therein the variation of strength accompanying the change of the cooling rate cannot be avoided in very thick steel plates.

JP-A-58-77528 discloses a steel containing Nb and B in which a stable hardness distribution is obtained. The cooling rate must be controlled to the range of from 15 to 40° C./second to make the structure bainite. However, because it is difficult to strictly control the cooling rate in the central portion of the thickness of the steel plate, a uniform structure is not obtained in the thickness direction of the steel plate so that the strength is uneven and island-form martensite forms which degrades ductility and the toughness.

JP-A-54-132421 discloses a technique for improving welding properties in which a high-tension bainite steel is produced by using a very low carbon content and also by rolling the steel at a finishing temperature of 800° C. or lower to obtain a tough product suitable for line pipe. However, rolling is finished at a low-temperature so that productivity is low. Further, when a thick steel plate is to be cut to a definite length, the cutting may cause a strain.

In JP-A-8-144019, the present inventors have proposed steel products having more uniform quality in which a very low carbon content is used. These products also have excellent shock resisting characteristics of a welding heat influencing portion (HAZ) at 0° C. However, even in these steel products the shock resisting characteristics of the welding heat influencing portion (HAZ) are not always good at a temperature of −20° C., and thus further improvements are desired.

SUMMARY OF THE INVENTION

It is an object of the present invention to provide a high-strength and high-toughness steel product having less variation in quality and excellent shock resisting characteristics of HAZ at a very low temperature, and to provide a method of producing such a steel product.

That is, according to an aspect of the present invention, a high-strength and high-toughness steel product that has excellent welding portion toughness comprises at least about 0.001% and less than about 0.030% by weight C, no more than about 0.60% by weight Si, from about 0.8 to 3.0% by weight Mn, from about 0.005 to 0.20% by weight Nb, from about 0.0003 to 0.0050% by weight B, and no more than about 0.005% by weight Al, with the remainder being Fe and incidental impurities, wherein at least 90% of the product has a bainite structure.

According to another aspect of the present invention, a method of producing a high-strength and high-toughness steel product includes heating and thereafter hot-rolling a slab having a composition comprising at least about 0.001% and less than about 0.030% by weight C, no more than about 0.60% by weight Si, from about 0.8 to 3.0% by weight Mn, from about 0.005 to 0.20% by weight Nb, from about 0.0003 to 0.0050% by weight B, and no more than about 0.005% by weight Al. In the method the slab is heated to a temperature of from $Ac_3$ to 1350° C., the hot rolling is finished at a temperature of at least 800° C., and the hot-rolled product is thereafter air-cooled.

DETAILED DESCRIPTION OF THE INVENTION

Figure 1:
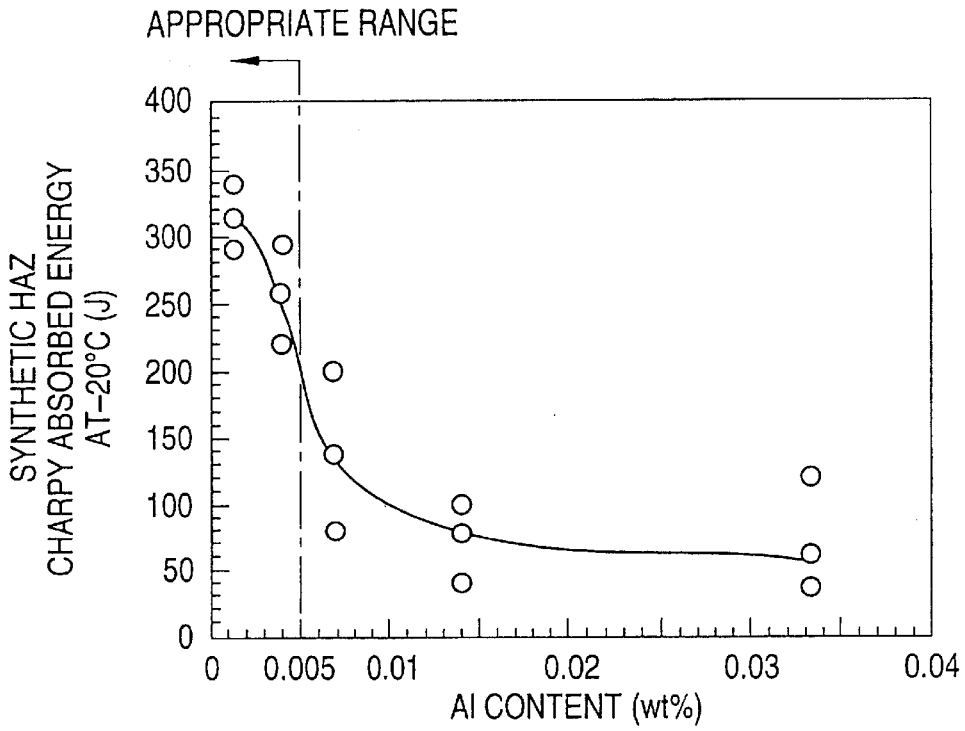
FIG. 1 is a graph showing the relation of the Al content in a thin steel product and the Charpy absorption energy of the reproduction welding heat influencing portion at −20° C.

The inventors have found that the variation of the quality of a thick steel product is caused by a variation in the steel structure due to changes of the cooling rate in the thickness direction and by changes of the cooling rate caused by the differences of production conditions. That is, the inventors have found that it is important to obtain a homogeneous structure over a wide range of cooling rates.

The inventors have discovered that by changing the alloy composition of a steel, and regardless of the change of a cooling rate, the uniformity of the structure in the thickness direction of a steel product can be improved. The structure of the steel product can be uniformly changed to a bainite structure by adding appropriate amounts of Nb and B to a steel having a very low content of C over wide range of cooling rates. Further, because the steel has a bainite structure, the steel is sufficiently strong.

In addition, by reducing the content of C in the steel product, by reducing Pcm (welding split susceptibility composition), and by investigating the influences of components on the toughness of the welded portions, it has been discovered that lowering the Al content improves the toughness of the welded portions at a low temperature.

In a preferred embodiment of the present invention, a high-strength and high-toughness steel product that has excellent welding portion toughness includes at least about 0.001% and less than about 0.030% by weight C, no more than about 0.60% by weight Si, from about 0.8 to 3.0% by weight Mn, from about 0.005 to 0.20% by weight Nb, from about 0.0003 to 0.0050% by weight B, and no more than about 0.005% by weight Al, with the remainder being Fe and incidental impurities. Preferably, at least 90% of the product has a bainite structure.

The reasons for limiting each of the components of the composition of the steel product to the above described ranges are set forth below.

Carbon. The content of C of the steel product should be at least 0.001% by weight to make the steel product a bainite single phase without depending onto a cooling rate. On the other hand, when the content of C is more than 0.030% by weight, carbides are deposited in the inside or the lath boundary of the bainite structure and the precipitation form of the carbides changes with a change of the cooling rate, making it difficult to obtain a constant strength over a wide range of cooling rates.

Silicon. When the Si content exceeds 0.60% by weight, the toughness of the welded portions deteriorates.

Manganese. The Mn content should be at least 0.8% by weight to increase the volume ratio of the bainite single phase, particularly the bainite structure, to 90% or higher. Increasing the Mn content to more 3.0% by weight increases the hardness by welding and degrades the toughness in the welding heat influenced portions (HAZ).

Niobium. Nb has, in particular, the effect of lowering $Ar_3$ and extending the bainite-forming range to a low cooling rate side and is important for obtaining the bainite structure. Also, Nb contributes to precipitation strength and is also effective for the improvement of the toughness. At least 0.005% by weight Nb is necessary, but when the content of Nb exceeds 0.20% by weight, the toughness improvement stops and the addition of more is uneconomical.

Boron. At least 0.0003% by weight B is necessary to obtain a bainite single phase. When the content of B exceeds 0.0050% by weight, BN (boron nitride) precipitates and degrades welding properties.

Aluminum. Al is an important element in this invention. When the Al content exceeds 0.005% by weight, the toughness at a low temperature (−20° C.) in HAZ is reduced, so that it is important to keep the Al content no more than 0.005% by weight, and preferably below 0.004% by weight. FIG. 1 shows the result of determining the relation of the Al content and the Charpy absorption energy of the reproduction HAZ at −20° C. In addition, the heat cycle of the reproduction HAZ is the condition of cooling from 800° C. to 500° C. for 300 seconds after heating to 1350° C. and the condition corresponding to the welding heat input of 500 kJ/cm.

As is clear from FIG. 1, when the content of Al is below 0.005% by weight, the shock resisting characteristics of the steel product at −20° C. are greatly improved.

The HAZ toughness is improved because the reduced Al content restrains the formation of a crude lath-form bainite structure having a low toughness and the steel product achieves a bainite structure with a high toughness containing relatively fine granular (polygonal) ferrite.

The Al content of a typical steel product is from 0.02 to 0.05% by weight. This causes the crystal grains to become crude when exposed to high temperature welding heat. The steel is transformed into a crude lath-form bainite structure in the cooling process, and the HAZ toughness deteriorates.

In contrast, in the present invention, the Al content of the steel product is reduced so that a bainite structure containing polygonal ferrite in the grain boundary is obtained without creating a lath-form bainite structure in the cooling process. The structure has a good HAZ toughness.

By modifying the components of the steel composition as described above, a steel product having a homogeneous composition wherein at least 90% has a bainite structure can be obtained over a wide range of production conditions, and in particular over a wide range of cooling rates.

Figure 2:
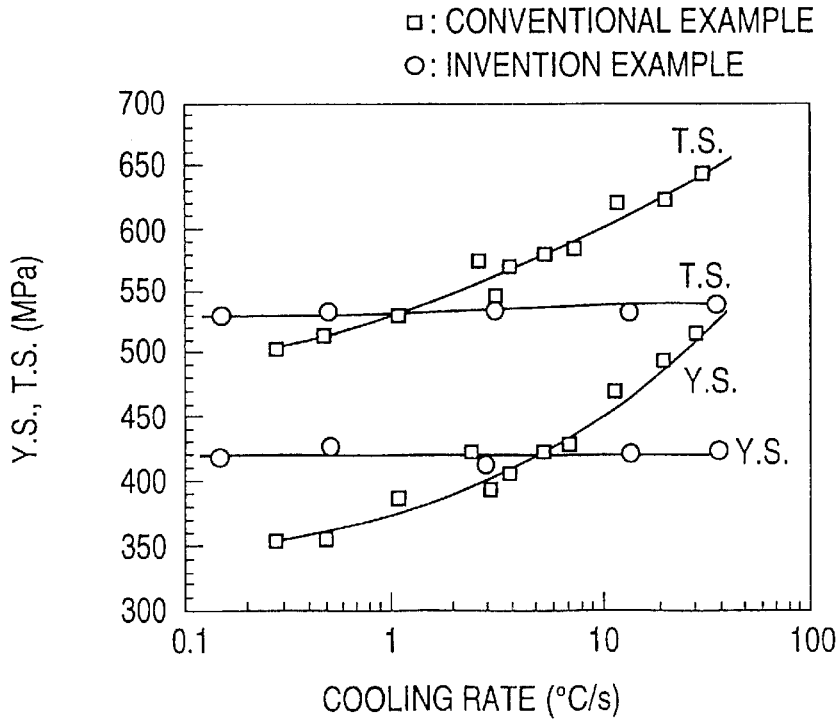
FIG. 2 is a graph showing the relation of the cooling rate of a thin steel product and the strength thereof.

FIG. 2 shows the results of determining the tensile strengths of steel plates obtained by changing the cooling rate within the range of from 0.1 to 50° C./second for both the present invention and conventional steel. As shown therein, steel products according to the present invention achieve a constant strength regardless of the cooling rate.

Particularly, in the present invention, the variations of the Y.S. value and the T.S. value can be reduced over a wide range of cooling rates, which is unexpected. Further, a high toughness can be attained by reducing the Al content.

The reason for this is believed to be that the content of C is reduced and that the Mn, Nb, and B have the effects described above. Accordingly, even when the cooling rate is changed in the thickness direction of the steel plate, a steel plate having more uniform quality in the thickness direction of the steel plate can be obtained without changing the strength.

In the example of FIG. 2, the embodiment of the steel product of the present invention had 0.011% by weight C, 0.21% by weight Si, 1.55% by weight Mn, 0.031% by weight Nb, 0.0012% by weight B, and 0.003% by weight Al with the rest being Fe and incidental impurities. The conventional steel product had 0.14% by weight C, 0.4% by weight Si, 1.31% by weight Mn, 0.024% by weight Al, 0.015% by weight Nb, and 0.013% by weight Ti, with the rest being Fe and incidental impurities.

Both embodiments used the same production process to produce steel plates having a thickness of 15 mm, while varying the cooling rate. The tensile strength was measured for each test piece sampled from each steel plate.

The fundamental composition of the steel product of this invention has been explained above but further improvements in strength, toughness, etc., can be achieved by adding other elements as explained below. The homogeneous structure of the steel product is scarcely influenced by the addition of the new elements.

The strength of the steel product may be improved by adding from about 0.05 to 3.0% by weight Cu, from about 0.005 to 0.20% by weight Ti, and/or from about 0.005 to 0.20% by weight V as precipitation strengthening components.

Copper. Cu may be added for precipitation strengthening and solid solution strengthening. When the content of Cu exceeds 3.0% by weight, the toughness suddenly deteriorates and when the content thereof is less than 0.05% by weight, the effect of precipitation strengthening and solid solution strengthening is less.

Titanium. Ti lowers the $Ar_3$ point to facilitate formation of the bainite structure and improves the toughness of the welded portions by the formation of TiN, and further effectively contributes to precipitation strengthening. However, when the content of Ti is less than 0.005% by weight, the addition effect is poor and when the content thereof exceeds 0.20% by weight, the toughness of the steel product deteriorates.

Vanadium. V is also added for precipitation strengthening in an amount of at least 0.005% by weight but when V exceeds 0.20% by weight, the effect reaches saturation.

Also, to further improve the strength of the steel product, one or more of the following may be added: not more than 3.0% by weight Ni, not more than 0.5% by weight Cr, not more than 0.5% by weight Mo, not more than 0.5% by weight W, and not more than 0.5% by weight Zr.

Nickel. Ni improves the strength and the toughness of the steel product of the invention and also has the effect of preventing Cu cracking at rolling when Cu has been added. However, Ni is expensive and the effect reaches saturation when more than 3.0% by weight is added. When the amount of Ni is less than 0.05% by weight, the above-descried effect is not always sufficiently obtained, and thus it is preferred that the addition amount thereof is at least 0.05% by weight.

Chromium. Cr improves the strength of the steel product but when Cr exceeds 0.5% by weight, the toughness of the welded portions deteriorates. It is preferred that the lower limit of the Cr is 0.05% by weight.

Molybdenum. Mo increases the strength of the steel product at normal temperatures and higher. However, when Mo exceeds 0.5% by weight, the weldability of the steel product deteriorates. In addition, when Mo is less than 0.05% by weight, the effect of increasing the strength is not observed, so it is preferred that the lower limit of the addition amount of Mo is 0.05% by weight.

Tungsten. W increases the strength of the steel product at a high temperature. However, because W is expensive and also when W is added exceeding 0.5% by weight, the toughness of the steel product deteriorates. In addition, when the W is less than 0.05% by weight, the strength-increasing effect is not observed, so it is preferred that the lower limit of the W is 0.05% by weight.

Zirconium. Zr increases the strength of the steel product and also improves the plating cracking resistance when zinc plating is applied to the steel product. However, when Zr is added exceeding 0.5% by weight, the toughness of the welded portions deteriorates. In addition, it is preferred that the lower limit of the Zr is 0.05% by weight.

Furthermore, to improve the toughness of HAZ, at least one rare earth metal (REM) and Ca can be added in the range of not more than 0.02% by weight.

REM in this invention means lanthanide series elements and mischmetal may be used as the source for the REM. REM improves the toughness of HAZ by restraining the growth of austenite grains by becoming the oxysulfide thereof. However, when REM exceeds 0.02% by weight, the cleanness of the steel product is spoiled. In addition, when the REM is less than 0.001% by weight, the effect of improving the toughness of HAZ is poor, so it is preferred that the lower limit of the addition amount thereof is 0.001% by weight.

Calcium. Ca not only improves the toughness of HAZ but also effectively contributes to the improvement of the quality in the thickness direction of the steel plate by controlling the form of sulfides in the steel. However, when Ca exceeds 0.02% by weight, inside defects are increasingly generated. In addition, when the addition amount of Ca is less than 0.0005% by weight, the above-described effects are insufficient and thus it is preferred that the lower limit of the addition amount of Ca is 0.0005% by weight.

The production method of the present invention will now be described.

Since the components of the composition of the steel of the present invention provide a homogeneous structure, it is not necessary to strictly control the production conditions and the steel products may be produced according to conventional methods. That is, the slab having the modified composition of the components as described above is heated, hot rolled, and cooled.

In the recommended production process of the invention, a steel slab having the composition described above, is heated to a temperature of from the $Ac_3$ temperature to 1350° C., thereafter hot-rolled at a temperature of at least 800° C., and then subjected to air cooling or accelerated cooling.

When the heating temperature is lower than the $Ac_3$ temperature, a complete austenite phase cannot be formed and the homogenization becomes insufficient, and when the heating temperature exceeds 1350° C. the surface oxidation becomes severe. Accordingly, the steel slab is preferably heated to the temperature range of from $Ac_3$ temperature to 1350° C.

Also, when the rolling finishing temperature is lower than 800° C., the rolling efficiency is lowered, so it is also preferred that the rolling finishing temperature is higher than 800° C.

However, in the prior art the cooling after rolling had to be strictly controlled. For example, it has hitherto been required to control the cooling temperature within the range of about ±3° C. However, in the present invention, it is not necessary to strictly control cooling as required in conventional techniques and air cooling or accelerated cooling can be employed.

Also, it is preferred that the cooling rate is from 0.1 to 80° C./second. If cooling is carried out at a cooling rate exceeding 80° C./second, the bainite lath interval becomes dense and the strength may vary with the cooling rate. If the cooling rate is lower than 0.1° C./second, ferrite is formed and the structure is less likely to achieve a bainite single phase.

Also, by adding various treatment steps to the above-described production process, the levels of the strength and the toughness of the steel products produced can be properly controlled as in the case of adding the further components described above.

When adding Cu, Ti, V, etc., as the strengthening components, after finishing rolling, the rolled steel is acceleration-cooled to a definite temperature of 500° C. or higher but lower than 800° C., which is the precipitation treatment temperature region, at a cooling rate of from 0.1 to 80° C./second. Thereafter, the strength may be increased by maintaining the definite temperature for at least 30 seconds, or by carrying out a precipitation treatment of cooling for at least 30 seconds at a cooling rate of 1° C./seconds or lower within this temperature range.

When the cooling rate from finishing rolling to the precipitation treatment temperature is lower than 0.1° C./second, ferrite is formed in the bainite structure, while when the cooling rate exceeds 80° C./second, the bainite lath interval becomes dense and the strength increases depending upon the cooling rate. Thus, the preferred cooling rate is in the range of 0.1 to 80° C./second.

After the accelerated cooling treatment, and by maintaining a constant temperature for at least 30 second at the temperature range of 500° C. to 800° C., or carrying out a precipitation treatment of cooling for at least 30 seconds at a cooling rate of 1° C./second or lower within this temperature range, at least one kind or two or more kinds of Cu, Ti(CN), and V(CN), and further Nb(CN) are precipitated, whereby the strength of the steel product increases. Also, by the precipitation treatment, the structure is homogenized and the variation of quality in the thickness direction of the steel plate is further improved.

In this case, when the temperature of the precipitation treatment is 800° C. or higher, the precipitating components are still dissolved and the precipitation may not occur sufficiently. When the temperature is lower than 500° C., the precipitation may not occur sufficiently. The reason the maintaining time is at least 30 seconds is that if the maintaining time is shorter than 30 seconds, sufficient precipitation strengthening may not be achieved. Furthermore, by cooling for at least 30 seconds at a cooling rate of 1° C./second within the above noted temperature range, precipitation strengthening is also obtained, although sufficient precipitation is not achieved when the cooling rate exceeds 1° C./second. For sufficient precipitation strengthening, it is desirable that the cooling rate is 0.1° C./second or lower.

Moreover, the above-described precipitation treatment can be carried out after cooling following rolling. That is, after cooling, the rolled steel is heated again to a temperature from 500° C. to 800° C. and maintained at the temperature for at least about 30 seconds.

The following examples are intended to illustrate the present, invention practically but not to limit the invention in any way.

EXAMPLE 1

Each of the steel slabs having various modified compositions shown in Table 1 below was heated to 1150° C., thereafter, rolling wherein the total draft became 74% was finished at a finishing temperature of 800° C., and thereafter, acceleration cooling (cooling rate: 7° C./second) was carried out to produce each steel plate of 80 mm in thickness.

Each steel plate was subjected to a tension test and a Charpy test to determine the mechanical properties and also to evaluate the variation of strength in the thickness direction. The hardness of the cross section of the steel plate was measured at a 2 mm pitch from the surface thereof to determine the hardness distribution in the thickness direction of the steel plate. Furthermore, to evaluate the toughness of HAZ, after heating each steel plate to 1350° C., a heat cycle of cooling from 800° C. to 500° C. for 300 seconds (corresponding to the thermal history of HAZ in the case of welding at the inlet heat amount of 500 kJ/cm) was applied, then the Charpy test piece was sampled, and the Charpy absorption energy at −20° C. was measured.

These determination results are shown in Table 2.

TABLE 1

(Wt %)

| Kind | C | Si | Mn | Nb | B | Al | Cu | Ti | V | Ni | Cr | Mo | W | Zr | REM | Ca | Note |
|---|---|---|---|---|---|---|---|---|---|---|---|---|---|---|---|---|---|
| A | 0.0007 | 0.32 | 1.55 | 0.032 | 0.0015 | 0.004 | — | — | — | — | — | — | — | — | — | — | C |
| B | 0.001 | 0.22 | 1.51 | 0.031 | 0.0017 | 0.002 | — | — | — | — | — | — | — | — | — | — | A |
| C | 0.007 | 0.27 | 1.64 | 0.029 | 0.0021 | 0.004 | — | — | — | — | — | — | — | — | — | — | A |
| D | 0.018 | 0.25 | 1.59 | 0.019 | 0.0022 | 0.005 | — | — | — | — | — | — | — | — | — | — | A |
| E | 0.037 | 0.33 | 1.48 | 0.018 | 0.0015 | 0.003 | — | — | — | — | — | — | — | — | — | — | C |
| F | 0.006 | 1.01 | 1.77 | 0.017 | 0.0019 | 0.003 | — | — | — | — | — | — | — | — | — | — | C |
| G | 0.015 | 0.02 | 0.45 | 0.021 | 0.0009 | 0.005 | — | — | — | — | — | — | — | — | — | — | C |
| H | 0.016 | 0.03 | 3.20 | 0.017 | 0.0008 | 0.004 | — | — | — | — | — | — | — | — | — | — | C |
| I | 0.009 | 0.33 | 1.62 | 0.002 | 0.0022 | 0.027 | — | — | — | — | — | — | — | — | — | — | C |
| J | 0.011 | 0.35 | 1.65 | 0.49 | 0.0024 | 0.004 | — | — | — | — | — | — | — | — | — | — | C |
| K | 0.014 | 0.03 | 1.50 | 0.021 | — | 0.001 | — | — | — | — | — | — | — | — | — | — | C |
| L | 0.012 | 0.08 | 1.51 | 0.024 | 0.0087 | 0.002 | — | — | — | — | — | — | — | — | — | — | C |
| M | 0.017 | 0.15 | 1.79 | 0.024 | 0.0026 | 0.025 | — | — | — | — | — | — | — | — | — | — | C |
| N | 0.008 | 0.25 | 1.77 | 0.015 | 0.0024 | 0.001 | — | — | — | 0.62 | — | — | — | — | — | — | A |
| O | 0.009 | 0.33 | 1.48 | 0.018 | 0.0011 | 0.002 | — | — | — | — | 0.29 | 0.31 | — | — | — | 0.002 | A |
| P | 0.017 | 0.37 | 1.45 | 0.017 | 0.0008 | 0.004 | — | — | — | 0.71 | — | — | — | 0.02 | — | — | A |
| Q | 0.015 | 0.29 | 1.56 | 0.024 | 0.0021 | 0.005 | — | — | — | 0.48 | — | — | 0.15 | — | 0.006 | — | A |
| R | 0.012 | 0.05 | 1.54 | 0.045 | 0.0011 | 0.005 | — | — | — | — | — | 0.25 | — | 0.02 | — | — | A |
| S | 0.014 | 0.08 | 1.81 | 0.051 | 0.0017 | 0.003 | — | — | — | 0.58 | — | — | — | — | 0.006 | — | A |
| T | 0.009 | 0.15 | 1.65 | 0.040 | 0.0013 | 0.004 | — | 0.09 | — | — | — | — | — | — | — | — | A |
| U | 0.017 | 0.09 | 1.78 | 0.022 | 0.0012 | 0.002 | 1.75 | 0.01 | — | — | — | — | — | — | — | — | A |

TABLE 1-continued

| Kind | C | Si | Mn | Nb | B | Al | Cu | Ti | V | Ni | Cr | Mo | W | Zr | REM | Ca | (Wt %) Note |
|---|---|---|---|---|---|---|---|---|---|---|---|---|---|---|---|---|---|
| V | 0.018 | 0.28 | 1.84 | 0.024 | 0.0011 | 0.003 | — | — | 0.05 | — | — | — | — | — | — | — | A |
| W | 0.005 | 0.30 | 1.56 | 0.037 | 0.0011 | 0.005 | 1.09 | 0.01 | — | — | 0.31 | 0.12 | — | — | — | — | A |
| X | 0.008 | 0.33 | 1.84 | 0.022 | 0.0015 | 0.004 | — | — | 0.08 | 0.54 | — | — | — | — | 0.005 | — | A |
| Y | 0.011 | 0.35 | 1.55 | 0.014 | 0.0014 | 0.002 | — | 0.14 | — | 0.34 | — | — | 0.18 | 0.02 | — | 0.003 | A |

C: Comparative Example A: Appropriate Example

TABLE 2

| No. | Kind | Change of hardness* (ΔHv) | Y.S. (MPa) | T.S. (MPa) | Mother material vTrs (° C.) | Synthetic HAZ vE-20 (J) | Bainite volume ratio (%) | Note |
|---|---|---|---|---|---|---|---|---|
| 1 | A | 45 | 442 | 499 | −95 | 312 | 50 | C |
| 2 | B | 13 | 446 | 501 | −100 | 311 | 100 | A |
| 3 | C | 13 | 468 | 512 | −97 | 340 | 100 | A |
| 4 | D | 12 | 309 | 507 | −93 | 331 | 100 | A |
| 5 | E | 28 | 461 | 520 | −97 | 95 | 100 | C |
| 6 | F | 11 | 482 | 598 | −105 | 44 | 95 | C |
| 7 | G | 41 | 302 | 412 | −52 | 291 | 33 | C |
| 8 | H | 12 | 621 | 662 | −21 | 41 | 100 | C |
| 9 | I | 33 | 350 | 421 | −62 | 309 | 10 | C |
| 10 | J | 18 | 492 | 533 | −12 | 37 | 100 | C |
| 11 | K | 36 | 320 | 412 | −109 | 322 | 15 | C |
| 12 | L | 27 | 420 | 499 | −41 | 298 | 100 | C |
| 13 | M | 15 | 456 | 520 | −15 | 27 | 100 | C |
| 14 | N | 10 | 442 | 501 | −93 | 369 | 100 | A |
| 15 | O | 12 | 451 | 544 | −98 | 265 | 100 | A |
| 16 | P | 14 | 460 | 517 | −101 | 249 | 100 | A |
| 17 | Q | 16 | 421 | 520 | −85 | 321 | 100 | A |
| 18 | R | 15 | 466 | 530 | −84 | 322 | 100 | A |
| 19 | S | 14 | 431 | 542 | −105 | 264 | 100 | A |
| 20 | T | 9 | 422 | 517 | −74 | 241 | 100 | A |
| 21 | U | 12 | 410 | 508 | −74 | 287 | 100 | A |
| 22 | V | 17 | 432 | 517 | −88 | 326 | 100 | A |
| 23 | W | 16 | 445 | 511 | −81 | 304 | 100 | A |
| 24 | X | 11 | 421 | 521 | −101 | 289 | 100 | A |
| 25 | Y | 13 | 469 | 547 | −92 | 266 | 100 | A |

C: Comparative Example A: Appropriate Example

*: Difference between the maximum value and the minimum value of the hardness.

As shown in Table 2, it can be seen that because each of the steel plates of the present invention has a tensile strength of at least 400 MPa and has a homogeneous structure, the variation of the hardness in the thickness direction of the steel plate is very small as compared with those of the comparative examples and the difference between the maximum value and the minimum value of the hardness is within 20 as $H_v$.

In addition, the volume ratio of the bainite structure was measured by point counting from an optical microphotograph at a 400 magnification.

EXAMPLE 2

Each of the steel slabs having various modified compositions shown in Table 3 was treated by each of the various conditions shown in Table 4 to produce steel plates of 80 mm in thickness.

Each of the steel plates was subjected to a tensile test and the Charpy test as in Example 1 to determine the mechanical strength and also the variation of the strength in the thickness direction of the steel plate.

These determination results are shown in Table 5.

TABLE 3

| Kind | C | Si | Mn | Nb | B | Al | Cu | Ti | V | Ni | Cr | Mo | W | Zr | REM | Ca | (wt %) Note |
|---|---|---|---|---|---|---|---|---|---|---|---|---|---|---|---|---|---|
| A | 0.005 | 0.33 | 1.31 | 0.045 | 0.0021 | 0.003 | — | — | — | — | — | — | — | — | — | — | A |
| B | 0.011 | 0.25 | 1.58 | 0.051 | 0.0018 | 0.004 | — | 0.01 | — | — | — | — | — | — | — | — | A |
| C | 0.007 | 0.22 | 1.57 | 0.018 | 0.0022 | 0.004 | 1.07 | — | — | — | — | — | — | — | — | — | A |
| D | 0.010 | 0.36 | 1.87 | 0.021 | 0.0015 | 0.003 | — | — | 0.04 | — | — | — | — | — | — | — | A |
| E | 0.015 | 0.34 | 1.54 | 0.022 | 0.0009 | 0.004 | 0.98 | — | — | 0.61 | — | — | — | — | 0.006 | — | A |
| F | 0.014 | 0.22 | 1.51 | 0.025 | 0.0015 | 0.015 | 1.01 | — | — | 0.59 | — | — | — | — | 0.006 | — | C |
| G | 0.013 | 0.23 | 1.45 | 0.032 | 0.0011 | 0.003 | — | 0.01 | 0.05 | — | — | — | — | — | — | — | A |
| H | 0.017 | 0.06 | 2.27 | 0.025 | 0.0013 | 0.005 | 1.02 | — | — | — | — | — | — | 0.02 | — | — | A |
| I | 0.011 | 0.09 | 1.69 | 0.021 | 0.0018 | 0.004 | 1.05 | — | — | — | — | — | — | — | — | — | A |

TABLE 3-continued

| Kind | C | Si | Mn | Nb | B | Al | Cu | Ti | V | Ni | Cr | Mo | W | Zr | REM | Ca | (wt %) Note |
|---|---|---|---|---|---|---|---|---|---|---|---|---|---|---|---|---|---|
| J | 0.005 | 0.21 | 1.74 | 0.022 | 0.0025 | 0.003 | 1.78 | 0.01 | — | — | — | — | — | — | — | — | A |
| K | 0.014 | 0.21 | 1.48 | 0.020 | 0.0020 | 0.004 | 1.15 | 0.03 | — | — | — | — | — | — | — | — | A |
| L | 0.012 | 0.09 | 1.65 | 0.022 | 0.0015 | 0.001 | 1.06 | 0.45 | — | — | — | — | — | — | — | — | C |
| M | 0.016 | 0.02 | 1.74 | 0.029 | 0.0017 | 0.002 | 1.21 | 0.01 | 0.01 | — | — | — | — | — | — | — | A |
| N | 0.009 | 0.05 | 1.64 | 0.011 | 0.0021 | 0.003 | 0.76 | 0.02 | — | 0.78 | — | — | — | 0.02 | — | — | A |
| O | 0.007 | 0.21 | 1.55 | 0.033 | 0.0022 | 0.001 | 1.06 | 0.01 | — | — | 0.31 | — | 0.09 | — | — | — | A |
| P | 0.014 | 0.15 | 1.48 | 0.024 | 0.0017 | 0.002 | 1.02 | — | — | — | — | — | — | — | 0.006 | 0.003 | A |
| Q | 0.014 | 0.22 | 1.55 | 0.015 | 0.0009 | 0.002 | 0.99 | 0.01 | — | 0.57 | — | 0.11 | — | — | 0.006 | — | A |

C: Comparative Example A: Appropriate Example

TABLE 4

| No. | Kind | Heating temperature (° C.) | Finishing rolling temperature (° C.) | Cooling rate** (° C./sec) | Finishing cooling temperature (° C.) | Precipitation treatment condition | Cooling rate* (° C./sec) | Note |
|---|---|---|---|---|---|---|---|---|
| 1 | A | 1130 | 800 | Accel. (2.0) | 550 | 550° C. × 40 min. | Air (0.2) | A |
| 2 | B | 1130 | 850 | Accel. (7.0) | 550 | 550° C. × 40 min. | Air (0.2) | A |
| 3 | C | 1130 | 800 | Accel. (1.0) | 570 | 550° C. × 40 min. | Air (0.2) | A |
| 4 | D | 1130 | 800 | Accel. (2.0) | 820 | 620° C. × 40 min. | Air (0.2) | A |
| 5 | E | 1130 | 800 | Air (0.2) | — | re-heating 550° C. × 40 min. | Air (0.2) | A |
| 6 | F | 1000 | 800 | Air (0.2) | — | re-heating 550° C. × 40 min. | Air (0.2) | C |
| 7 | G | 1130 | 800 | Accel. (1.5) | 550 | 590° C. × 40 min. | Air (0.2) | A |
| 8 | H | 1130 | 850 | Accel. (3.5) | 800 | 550° C. × 40 min. | Air (0.2) | A |
| 9 | I | 1130 | 850 | Accel. (1.5) | 550 | 550° C. × 40 min. | Air (0.2) | A |
| 10 | J | 1130 | 850 | Accel. (6.0) | 750 | cooling for 40 min. at 0.1° C./sec. | Air (0.2) | A |
| 11 | K | 1130 | 800 | Accel. (2.5) | 800 | 550° C. × 40 min. | Air (0.2) | A |
| 12 | L | 1130 | 800 | Accel. (3.0) | 550 | 550° C. × 30 min. | Air (0.2) | C |
| 13 | M | 1130 | 850 | Accel. (6.5) | 600 | 550° C. × 50 min. | Air (0.2) | A |
| 14 | N | 1130 | 850 | Accel. (6.0) | 670 | cooling for 40 min. at 0.05° C./sec. | Air (0.2) | A |
| 15 | O | 1130 | 800 | Air (0.2) | — | 550° C. × 40 min. | Air (0.2) | A |
| 16 | P | 1130 | 800 | Accel. (1.0) | 570 | re-heating 550° C. × 40 min. | Air (0.2) | A |
| 17 | Q | 1130 | 800 | Accel. (1.5) | 600 | 550° C. × 40 min. | Air (0.2) | A |

C: Comparetive Example A: Appropriate Example
**: Air: Air-cooling, Accel.: accelerated cooling The inside of ( ) shows the cooling rate.

TABLE 5

| No. | Kind | Change of hardness* (ΔHv) | Y.S. (MPa) | T.S. (MPa) | Mother material vTrs (° C.) | Synthetic HAZ vE-20 (J) | Bainite volume ratio (%) | Note |
|---|---|---|---|---|---|---|---|---|
| 1 | A | 8 | 415 | 492 | −59 | 337 | 100 | A |
| 2 | B | 13 | 396 | 507 | −62 | 322 | 95 | A |
| 3 | C | 5 | 521 | 587 | −65 | 289 | 100 | A |
| 4 | D | 11 | 485 | 521 | −57 | 308 | 99 | A |
| 5 | E | 12 | 578 | 621 | −63 | 257 | 100 | A |
| 6 | F | 15 | 569 | 628 | −68 | 45 | 100 | C |
| 7 | G | 15 | 491 | 521 | −69 | 322 | 100 | A |
| 8 | H | 20 | 591 | 641 | −70 | 313 | 100 | A |
| 9 | I | 13 | 542 | 599 | −59 | 304 | 100 | A |
| 10 | J | 12 | 501 | 612 | −68 | 322 | 100 | A |
| 11 | K | 13 | 575 | 501 | −55 | 331 | 100 | A |
| 12 | L | 11 | 601 | 521 | +15 | 18 | 95 | C |
| 13 | M | 15 | 472 | 645 | −57 | 297 | 100 | A |
| 14 | N | 15 | 473 | 592 | −63 | 336 | 100 | A |
| 15 | O | 12 | 521 | 592 | −59 | 310 | 98 | A |
| 16 | P | 15 | 534 | 597 | −51 | 298 | 100 | A |
| 17 | Q | 18 | 524 | 613 | −59 | 280 | 100 | A |

C: Comparative Example A: Appropriate Example
*: Difference between the maximum value and the minimum value of the hardness.

As shown in Table 5, each of the steel plates of the present invention has a tensile strength of at least 400 MPa and a homogeneous structure, and thus the variation of the hardness in the thickness direction of the steel plate is very small as compared with the comparative examples.

Also, it can be seen that by adding the precipitation strengthening element(s) and by applying the precipitation strengthening treatment, a further improvement of the strength is obtained as compared with the other examples of this invention shown in Table 2.

Thus, according to the present invention, a high-strength and high-toughness steel product having less variation of quality and having excellent shock resisting characteristics in the HAZ portions at −20° C. is obtained.

As will be appreciated by those of skill in the art, the present invention may be profitably applied to steel plates, steel sections, steel bars, etc.

While the present invention has been described in relation to certain preferred embodiments, it is to be understood that the present invention is defined by the accompanying claims, when read in light of the specification.

What is claimed is:

1. A steel product comprising at least about 0.001% and less than about 0.030% by weight C, not more than about 0.60% by weight Si, from about 0.8 to 3.0% by weight Mn, from about 0.005 to 0.20% by weight Nb, from about 0.0003 to 0.0050% by weight B, and not more than about 0.004% by weight Al, with the remainder being Fe and incidental impurities, wherein at least 90% of the product has a bainite structure.

2. The steel product of claim 1, further comprising at least one component selected from the group of components consisting of from about 0.05 to 3.0% by weight Cu, from about 0.005 to 0.20% by weight Ti, and from about 0.005 to 0.20% by weight V.

3. The steel product of claim 1, further comprising at least one component selected from the group of components consisting of not more than about 3.0% by weight Ni, not more than about 0.5% by weight Cr, not more than about 0.5% by weight Mo, not more than about 0.5% by weight W, and not more than about 0.5% by weight Zr.

4. The steel product of claim 2, further comprising at least one component selected from the group of components consisting of not more than about 3.0% by weight Ni, not more than about 0.5% by weight Cr, not more than about 0.5% by weight Mo, not more than about 0.5% by weight W, and not more than about 0.5% by weight Zr.

5. The steel product of claim 1, further comprising not more than about 0.2% by weight at least one of rare earth metals and Ca.

6. The steel product of claim 2, further comprising not more than about 0.2% by weight at least one of rare earth metals and Ca.

7. The steel product of claim 3, further comprising not more than about 0.2% by weight at least one of rare earth metals and Ca.

* * * * *